United States Patent [19]

von der Eltz et al.

[11] 4,304,566

[45] Dec. 8, 1981

[54] PROCESS FOR THE DYEING OF WOOL WITH REACTIVE DYESTUFFS

[75] Inventors: Hans-Ulrich von der Eltz, Frankfurt am Main; Armand Lehinant, Offenbach am Main; Joachim W. Lehmann, Kelkheim; Hans-Peter Maier, Sulzbach, all of Fed. Rep. of Germany

[73] Assignee: Hoechst Aktiengesellschaft, Frankfurt, Fed. Rep. of Germany

[21] Appl. No.: 90,262

[22] Filed: Nov. 1, 1979

[30] Foreign Application Priority Data

Nov. 4, 1978 [DE] Fed. Rep. of Germany ..... 2847913

[51] Int. Cl.[3] ..... D06P 1/38; D06P 1/384; D06P 3/872

[52] U.S. Cl. ..... 8/533; 8/543; 8/549; 8/934; 8/608; 8/619; 8/917; 8/930

[58] Field of Search ..... 8/54, 21 B, 533, 495, 8/543, 549, 934

[56] References Cited

U.S. PATENT DOCUMENTS 2,869,969 1/1959 Schulze ..... 8/21 C
3,930,795 1/1976 Fuchs et al. ..... 8/54
4,063,877 12/1977 Elliot et al. ..... 8/54
4,115,457 9/1978 Wiedemann ..... 8/54
4,219,332 8/1980 Abel et al. ..... 8/533

OTHER PUBLICATIONS

Von Bergen, W. Wool Handbook, vol. 2, pp. 690-691, Interscience Publ., N.Y. 1970.

*Primary Examiner*—Maria P. Tungol
*Attorney, Agent, or Firm*—Curtis, Morris & Safford

[57] ABSTRACT

A process for the dyeing of textiles consisting of wool without anti-felt finish or wool having an anti-felt finish in the form of a coating of a polyimine resin or a polyacrylic resin, or textiles containing such wool, with reactive dyes according to the exhaust method, which comprises dyeing said textiles in aqueous dyeing baths containing at least one commercial reactive dyestuff the starting pH of which is in the weakly acidic to neutral range, by heating rapidly to the dyeing temperature of 110° to 125° C. immediately after addition of the dissolved dyestuff, and by dyeing at this temperature for 10 to 20 minutes, while omitting the addition of pH-regulating substances during the whole dyeing operation.

10 Claims, No Drawings

PROCESS FOR THE DYEING OF WOOL WITH REACTIVE DYESTUFFS

Dyeing of wool with reactive dyes has been generally known and applied in the industrial practice for a long time. The use of reactive dyes in this field is important for producing particularly brilliant color shades, but above all for dyeing wool having an anti-felt finish obtained by a special treatment. The anti-felt finish on wool is obtained by coating the wool fibers with a film of, for example, polyimine or polyacrylic resin (according to the indications of Melliand Textilberichte 9/1971, p. 1100, or of Journal of the Society of Dyers and Colourists, Vol. 88, No. 3/1972, pp. 93–100). A textile article manufactured on this basis must resist, without any felting, the severe strain of repeated washings at 60° C. with the use of perborate-containing household detergents, and accordingly, it must be color-fast, which properties are neither required nor attained in the case of normal wool. Requirements for such a high fastness degree, especially with respect to fastness to washing and to perspiration, are satisfied above all by dyeings obtained with reactive dyes. Therefore, the dyestuff manufacturers provided and marketed for this application field special dyestuff sets comprising the most suitable reactive dyes for the fibers finished as described. In order to improve their application in the exhaust dyeing process, especially because of the levelling difficulties occurring, in many cases the reactive groups of these dyestuffs were temporarily blocked (that is, this blocking could be reversed during the dyeing operation), thus ensuring better levelling of the dyestuffs by an altered reaction mechanism.

Such processes are generally known from the literature, for example, from Journal of the Society of Dyers and Colourists 72/03/88, pp. 93–100, Melliand Textilberichte 1968/12, pp. 1444–1448, Textilveredlung 71/02/6, pp. 57–62, Textile World, Aug. 1964, p. 82 et seq., and Melliand Textilberichte 1974, p. 468 et seq.

All these state-of-the-art processes for the dyeing of wool and wool having an anti-felt finish involve the meeting of the following common requirements: the reactive dyestuffs cannot be subjected to the exhaust process in an acidic dyeing bath but with precise control of the pH, and towards the end of the dyeing period, the pH must be shifted to the less acidic or weakly alkaline range in order to produce the reactive bond between dyestuffs and fibers. Therefore, these processes are afflicted with the disadvantage that a full color yield and above all a sufficient levelness of the dyeings can be obtained only with a scrupulously precise and safe control of pH and temperature, as well as long dyeing periods. In order to meet the requirements of levelness, special dyeing processes have even been developed.

It is therefore the object of the present invention to simplify the dyeing of wool with reactive dyes and to reduce the critical items of processes therefor, while maintaining the high fastness degree of the dyeings, that is, producing a covalent bond of dyestuff and fibers.

In accordance with the invention, this object is achieved by using aqueous dyeing baths containing at least one commercial reactive dyestuff the starting pH of which is in the weakly acidic to neutral range, by heating rapidly to the dyeing temperature of 110° to 125° C. immediately after addition of the dissolved dyestuff, and by dyeing at this temperature for 10 to 20 minutes, while omitting the addition of pH-regulating substances during the whole dyeing operation.

According to the novel dyeing process, the dyeing baths are completely exhausted within 10 to 20 minutes, so that a good utilization of the dyestuff is ensured.

The wool treated according to the invention is not damaged under the conditions as described, despite the elevated dyeing temperature which is unusual for wool; that is, it is affected to that extent only which normally occurs in any known dyeing process and is generally accepted. Furthermore, agents for protecting the wool may be added to the dyeing baths. It was surprising to observe that the 33% aqueous formaldehyde solution normally used under these conditions in an amount of 5% (relative to the weight of the dry wool) causes insignificant losses of color depth; nearly, that is, the attainable color depth is virtually not reduced at all. Other wool protecting agents, for example protein condensation products, have no protective effect under the high temperature conditions applied.

For carrying out the process of the invention, the aqueous dyeing bath prepared which contains the goods made from normal wool or wool having an anti-felt finish is heated to 70°–80° C. without any pretreatment with alkalis or alkali donors, and bath and goods are maintained in this state for about 5 to 10 minutes for stabilization of the temperature and distribution of possibly added auxiliaries (wool protection agents). Separately, the reactive dyestuff or mixture of reactive dyestuffs is dissolved as usual in water, and then added to the dyeing bath at about 80°–90° C. Preliminary activation of the reactive dyestuff by means of alkalis as in the process known from Chemiefasern 1965, pp. 450/451 and 525/526 is omitted in this case. The pH of these liquors (measured at 20° C.) must be in the weakly acidic to neutral range, that is, a pH of about 4.0 to 7.0, preferably 6.0 to 7.0, should be maintained. Special adjustment of the pH is not necessary because aqueous solutions of commercial reactive dyestuffs are weakly acidic. On the other hand, industrial waters being softened by means of cation exchangers are often weakly alkaline and require adjustment of the pH to the above range, advantageously by means of acetic acid.

Immediately after the addition of the dissolved dyestuff, the dyeing bath is rapidly (within 5 to 10 minutes) heated to the dyeing temperature of 110° to 125° C., and the goods are dyed at this temperature for about 10 to 20 minutes. Subsequently, the bath and its contents are allowed to cool to about 80° C., and the dyeing obtained is rinsed with warm and cold water.

In order to improve the wet fastness of the wool so dyed, it is recommended to subject the dyeings produced in accordance with the invention to an after-treatment with 1 to 2% (relative to the weight of the dry goods) of aqueous 25% ammonia solution. This after-treatment can be carried out under the conditions as described before either for a further 5 to 15 minutes in the dyeing bath after exhaustion of the reactive dye and cooling to 70°–80° C., or in a freshly prepared ammonia bath.

The process of the invention is furthermore suitable for the single-bath dyeing of mixtures of wool or wool having an anti-felt finish and polyester fibers, where the advantages of the novel application mode for reactive dyes become clearly manifest. The dyeing baths used in these cases contain the predispersed disperse dyes in addition, while acid donors are not required. Such fiber mixtures can be dyed according to the invention in a single-step or two-step operation. In the latter one, the disperse dye may be added to the dyeing bath after the reactive dyestuff is exhausted, or, for example in high-speed dyeing processes, the reactive dyestuff may be fed to the high temperature apparatus with the disperse dye after a predyeing period for the polyester fiber portion.

Dyeing of such polyester fiber/wool mixtures according to the hitherto known dyeing processes required a dyeing temperature of maximum 106° C. and dyeing times of 45 minutes and more in order to spare the wool. Furthermore, the addition of carriers was necessary in these cases in order to fix the disperse dye in the polyester fiber under these conditions.

Now, the novel process allows use of reactive dyestuffs in addition to disperse dyes in a high temperature dyeing process for the dyeing of such mixtures.

For carrying out the process of the invention any dyeing apparatus and/or dyeing machine which allows a high temperature treatment of the goods is suitable. Thus, wool fibers may practically be dyed in all processing stages. There have not been encountered any difficulties with regard to material of varying affinity.

Compared with the known methods for dyeing wool by exhaustion, the process of the invention is distinguished by its simplicity and by a considerable reduction of the dyeing period. The fastness properties which are obtained correspond in all tests to those of dyeings which have been prepared according to the usual two-stage processes.

For the dyeing of normal wool or wool having an anti-felt finish, or the wool portion of fiber mixtures, according to the process of the invention, the reactive dyes suitable are the organic dyestuffs known by this term, independently of the nature of their reactive groups. This class of dyestuffs is termed "Reactive Dyes" in the Colour Index, 3rd edition, 1971. The dyestuffs concerned are predominantly those dyestuffs which contain at least one group which is able to react with polyhydroxyl fibers or wool, a precursor of such a reactive group, or a substituent that can be reacted with polyhydroxyl fibers or wool. As basic structures for the organic dyestuffs there are especially suitable those of the azo, anthraquinone and phthalocyanine dyestuff series, of which the azo and phthalocyanine dyestuffs may be metal-free or metal complexes. As reactive groups and precursors thereof there may be mentioned, for example, epoxy groups, the ethylene imide group, the vinyl grouping in vinylsulfone and acrylic acid radicals, the β-sulfatoethylsulfone group, the β-chloroethylsulfone group and the β-dialkylamino-ethylsuflone group. Furthermore there may be mentioned for this process derivatives of the tetrafluorocyclobutyl series, for example tetrafluorocyclobutylacrylic acid. As reactive substituents in reactive dyes there may be used those which can easily be split off to leave an electrophilic radical. As such substituents there may be mentioned, for example, from 1 to 3 halogen atoms on the following ring systems: quinoxaline, triazine, pyrimidine, phthalazine, pyridazine and pyridazone. Use may also be made of dyestuffs having two or more reactive groups, which may be the same or different.

According to the process of the invention, also the temporarily blocked reactive dyes cited before, which are obtained for example by reaction of β-sulfatoethylsulfone group-containing dyestuffs with N-methyltaurine, give dyeings on normal wool and wool having an anti-felt finish. However, depending on the individual dyestuffs, the color yield may be decreased in these cases as compared to the usual dyeing processes.

Suitable disperse dyes for the dyeing of the polyester fiber component are all water-insoluble dyestuffs listed in the Colour Index, 3rd ed. 1971, sub "Disperse Dyes". Such products are for example those from the series of azo, anthraquinone or quinophthalone dyestuffs, the azo dyestuffs being optionally used in metallic or metal-free form. Dyestuffs of the cited kind are generally known.

The following examples illustrate the invention.

EXAMPLE 1

In a high temperature dyeing apparatus and at a goods-to-liquor ratio of 1:15, crosswound cheeses of wool yarn having a total weight of 80 kg are dyed. The necessary dyeing bath is prepared with the use of water having a temperature of 80° C. and an amount equivalent to 5% of the weight of the wool (=4 kg) of 33% aqueous formaldehyde solution, and the bath is circulated for 10 minutes through the fiber material which is wound up. Subsequently, an amount equivalent to 2% of the weight of the wool (=1.6 kg) of the commercial dyestuff Reactive Orange 16, C.I. No. 17 757, is added to the liquor, which is then heated to 120° C. within 5 to 10 minutes. The goods are dyed for 15 minutes at this temperature. After cooling of liquor and goods to 80° C., the bath is let off and the wool is rinsed with water.

A full and fast scarlet dyeing of the wool is obtained.

EXAMPLE 2

Dyeing is carried out as in Example 1, but using 54 kg of woolen piece-goods, in a high temperature beam dyeing apparatus at a goods-to-liquor ratio of 1:20, with an amount equivalent to 1.2% of the weight of the goods of the commercial dyestuff of the formula

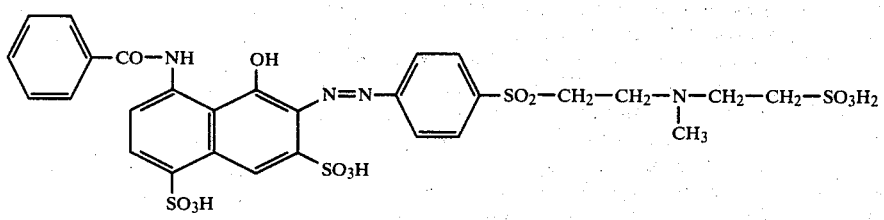

A fast red dyeing of the wool is obtained.

EXAMPLE 3

Dyeing is carried out as in Example 1, but without the addition of formaldehyde; 35 kg of wool yarn having an anti-felt finish are dyed with an amount equivalent to 6% (of the weight of the wool) of the commercial dyestuff Reactive Black 5, C.I. No. 20 505, and an amount equivalent to 0.1% of the weight of the wool of chromium (III) acetate sulfate. After exhaustion of the reactive dye in the liquor and cooling to 80° C., an amount equivalent to 1.5% of the weight of the wool of aqueous 25% ammonia solution is added to the bath, the dyeing is treated for a further 10 minutes under these conditions, and the yarn so dyed is then rinsed with water until it is clear.

A very fast, bloomy black dyeing is obtained.

The wool is provided with the anti-felt finish according to the processes described in Melliand Textilberichte 9, 191, p. 1100, and to Journal of the Society of Dyers and Colourists, Vol. 88, p. 93 et seq.

EXAMPLE 4

67 kg of wool yarn are dyed according to Example 1, using the following substances added to the bath:

An amount equivalent to 5% of the weight of the wool (=3.35 l) of aqueous formaldehyde solution (33% strength), and An amount equivalent to 1.3% of the weight of the wool (=0.871 kg) of the commercial dyestuff of the formula

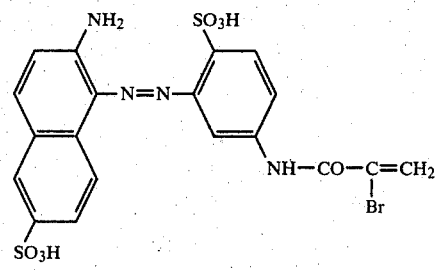

A clear, full orange dyeing having good fastness properties is obtained.

EXAMPLES 5 to 9

The following dyeings are obtained by operating as indicated in Example 4:

| Example | Commercial dye of the formula | Shade on wool |
|---|---|---|
| 5 | 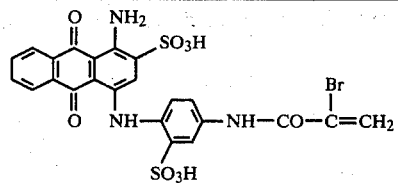 | blue |
| 6 | 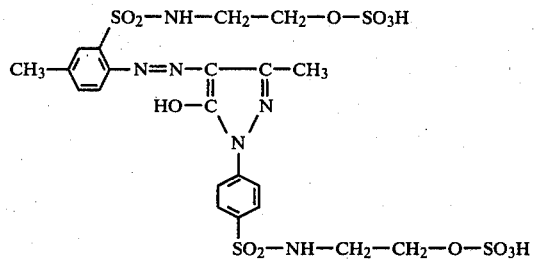 | yellow |
| 7 | 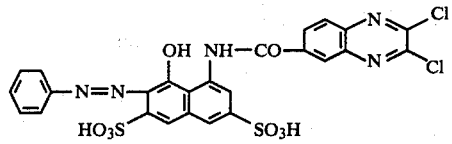 | red |
| 8 | 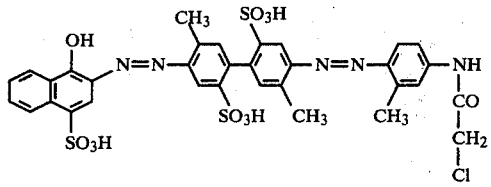 | scarlet |
| 9 | 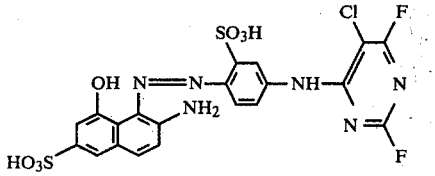 | red |

What is claimed is:

1. In a process for the dyeing of a textile containing wool without anti-felting finish, or wool having an anti-felting finish in the form of a coating layer of a polyimine resin or a polyacrylic resin, with reactive dyes according to the batchwise exhaustion method, the improvement which comprises contacting the textile material with an aqueous dyeing liquor containing one or more reactive dyestuffs, the initial pH value of said dye liquor being in the weakly acidic to neutral range, heating said dye liquor, beginning immediately after addition of the dissolved reactive dyestuff, to a dyeing temperature in the range of from 110° to 125° C. within 5 to 10 minutes, and dyeing the textile material at this temperature for 10 to 20 minutes, without pretreatment of the textile with an amphoteric auxiliary and without the addition of a pH-regulating substance in the course of the effective contact of the textile material with the dye liquor during the process.

2. A process as defined in claim 1, wherein the textile is wool or a blend thereof, and the dye liquor further contains from 1 to 5%, calculated on the weight of the dry textile material, of a wool protection agent.

3. A process as defined in claim 2, wherein the wool protection agent is an aqueous formaldehyde solution.

4. A process as defined in claim 1, 2 or 3, which further comprises dyeing a mixture of wool, or wool having an anti-felting finish, and polyester fibers in a two-step, single-bath operation, and adding one or more disperse dyes to the dye liquor after the reactive dyes have been exhausted.

5. A process as defined in claim 1, 2 or 3, which further comprises dyeing a mixture of wool, or wool having an anti-felting finish, and polyester fibers in a one-step, single-bath operation, the dye liquor additionally containing one or more disperse dyes, but not a pH-regulating substance.

6. A process as defined in claim 1, 2 or 3, which further comprises after-treating the dyed textiles, following the exhaust dyeing, for 5 to 15 minutes with an amount of an aqueous 25% ammonia solution equivalent to 1 to 2% of the weight of the dry textile material.

7. A process as defined in claim 6, wherein the after-treatment is carried out in the dyeing liquor itself after cooling same to a temperature in the range of from 70° to 80° C.

8. A process as defined in claim 6, which further comprises after-treating in a fresh bath.

9. A process as defined in claim 1, wherein the initial pH value of the aqueous dyeing liquor containing one or more reactive dyestuffs is of from 4 to 7.

10. A process as defined in claim 9, wherein said pH value is of from 6 to 7.

* * * * *